US009145713B1

(12) United States Patent
Norris

(10) Patent No.: US 9,145,713 B1
(45) Date of Patent: Sep. 29, 2015

(54) DOOR HANDLE EXTENSION FOR RECREATIONAL VEHICLES AND THE LIKE

(76) Inventor: David L. Norris, Rushville, IN (US)

( * ) Notice: Subject to any disclaimer, the term of this patent is extended or adjusted under 35 U.S.C. 154(b) by 121 days.

(21) Appl. No.: 13/595,701

(22) Filed: Aug. 27, 2012

Related U.S. Application Data

(60) Provisional application No. 61/527,855, filed on Aug. 26, 2011.

(51) Int. Cl.
*E05B 3/00* (2006.01)
*E05B 53/00* (2006.01)

(52) U.S. Cl.
CPC ..... *E05B 53/00* (2013.01)

(58) Field of Classification Search
CPC ..... E05B 1/53; E05B 53/00; E05B 79/12; E05B 85/18
See application file for complete search history.

(56) References Cited

U.S. PATENT DOCUMENTS

| | | | | |
|---|---|---|---|---|
| 1,204,072 | A | 11/1916 | Royack | |
| 1,530,696 | A | 3/1925 | Reed | |
| 2,928,690 | A * | 3/1960 | Larson | 292/336.3 |
| 3,144,268 | A | 8/1964 | Rowe | |
| 3,317,231 | A * | 5/1967 | Lindquist et al. | 292/336.3 |
| 4,006,927 | A | 2/1977 | Recupero | |
| 4,569,546 | A | 2/1986 | Howard et al. | |
| 4,890,868 | A | 1/1990 | Horvath et al. | |
| 5,193,863 | A | 3/1993 | McBain | |
| 5,425,155 | A | 6/1995 | Marciniak | |
| 5,555,779 | A | 9/1996 | Holden | |
| 6,502,873 | B1 | 1/2003 | Horseman | |
| 6,606,889 | B1 | 8/2003 | Tweedy | |
| 6,758,503 | B2 | 7/2004 | Sadler | |
| 6,789,601 | B2 | 9/2004 | Rooth | |
| 7,000,958 | B2 | 2/2006 | Garza et al. | |
| 7,237,812 | B2 | 7/2007 | Tweedy | |
| 2006/0137247 | A1 | 6/2006 | Levine | |

* cited by examiner

*Primary Examiner* — Mark Williams
(74) *Attorney, Agent, or Firm* — William F. Bahret

(57) ABSTRACT

A handle extension device for facilitating entry into a recreational vehicle or the like having an elevated door with a substantially flush outwardly pivoting door handle. The door handle extension comprises means for engaging the door handle so as to exert an outward force, and an operating handle operatively connected to and substantially below the engaging means. One embodiment employs a detachable hollow bar with an internal cable connecting the operating handle to a spring-biased lever arm configured to engage the inboard side of the pivoting handle on the vehicle door.

4 Claims, 8 Drawing Sheets

DOOR HANDLE EXTENSION FOR RECREATIONAL VEHICLES AND THE LIKE

CROSS-REFERENCE TO RELATED APPLICATION

This application claims the benefit of Provisional Patent Application No. 61/527,855, filed Aug. 26, 2011, which application is hereby incorporated by reference.

BACKGROUND OF THE INVENTION

This invention relates to auxiliary door opening devices, and more particularly to door handle extension devices for assisting children and those with poor balance in opening an elevated door on a recreational vehicle or the like.

SUMMARY OF THE INVENTION

The present invention provides a handle extension device for facilitating entry into a recreational vehicle or the like having an elevated door with a substantially flush outwardly pivoting door handle. The door handle extension comprises means for engaging the door handle so as to exert an outward force, and an operating handle operatively connected to and substantially below the engaging means.

According to one aspect of the invention, the door handle extension comprises an elongate mounting member configured for mounting on the vehicle door, an actuating member on the upper end of the mounting member and configured to operatively engage the pivoting handle on the vehicle door, an operating handle on the lower end of the mounting member, and a mechanical linkage interconnecting the actuating member and operating handle.

The objects and advantages of the present invention will be more apparent upon reading the following detailed description in conjunction with the accompanying drawings.

DESCRIPTION OF PREFERRED EMBODIMENTS

Figure 1:
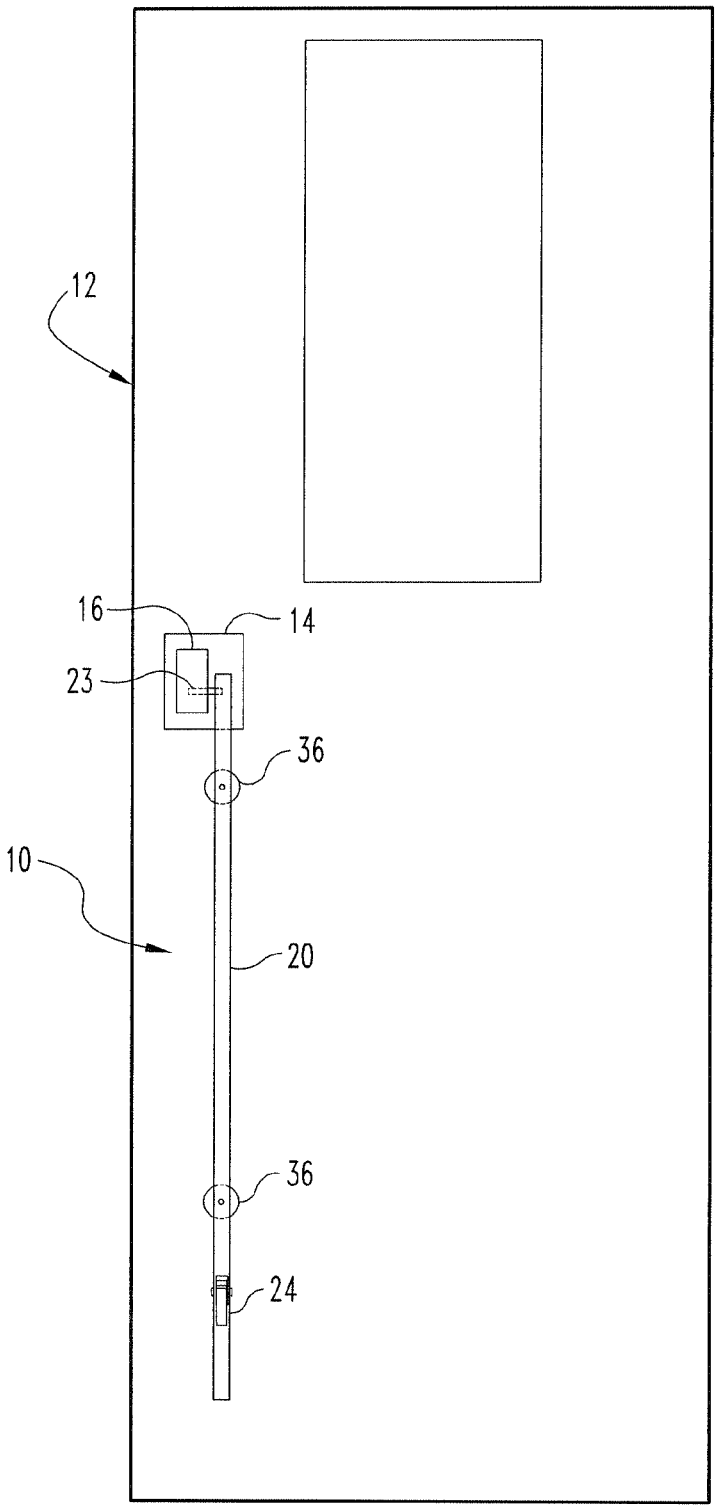
FIG. 1 is a front view of one embodiment of a door handle extension according to the present invention, mounted on a door having a substantially flush outwardly pivoting door handle such as found on recreational vehicles.
Figure 2:
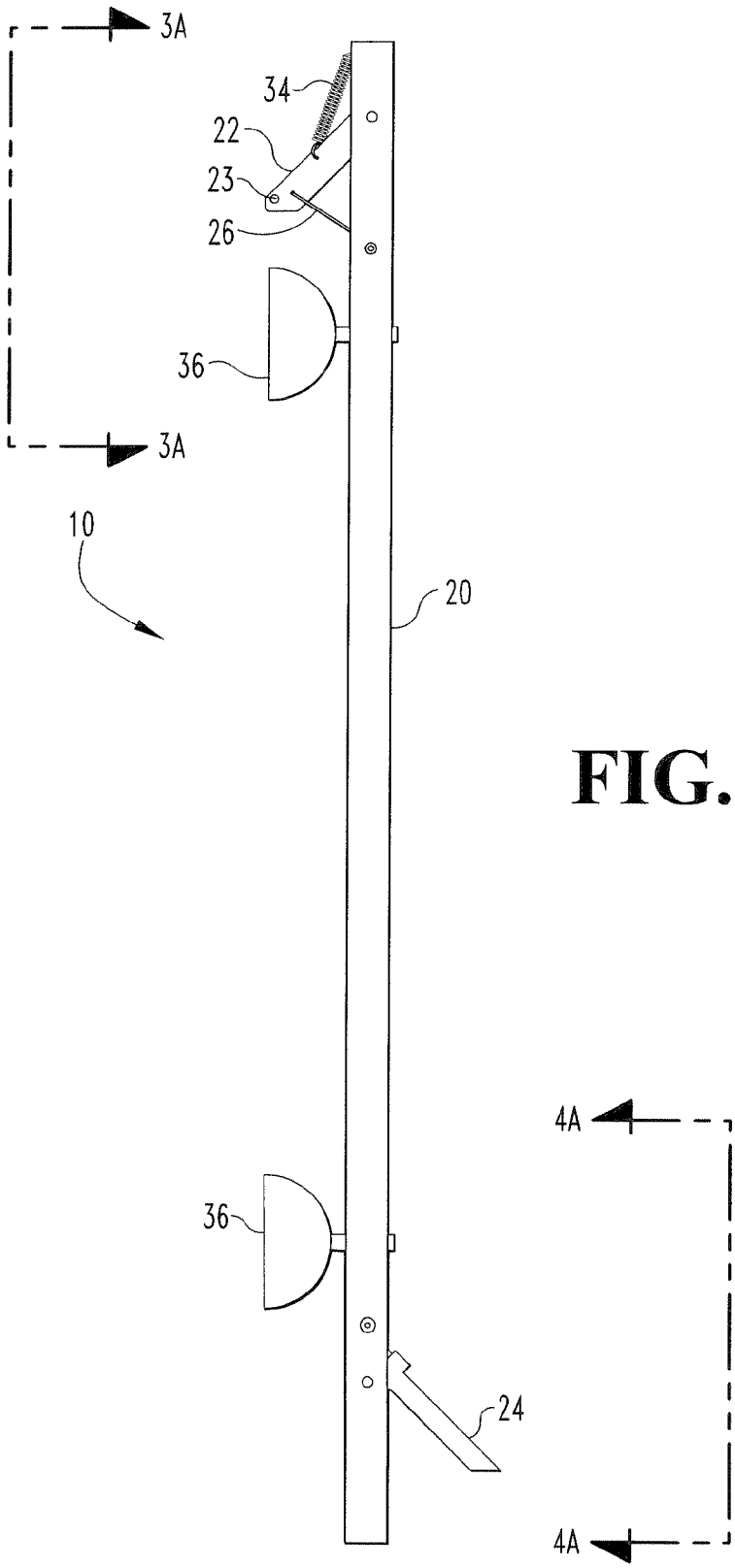
FIG. 2 is a left side view of the door handle extension of FIG. 1.
Figure 3:
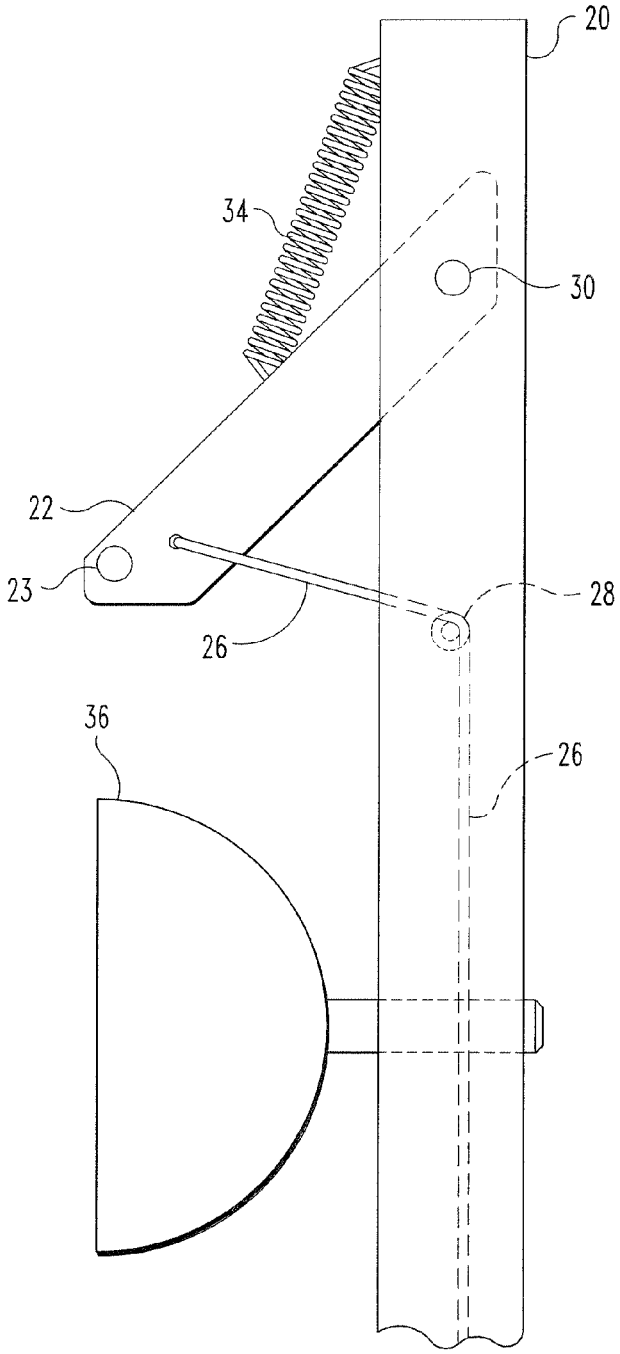
FIG. 3 is a left side view of the upper portion of the door handle extension of FIG. 1.
Figure 3A:
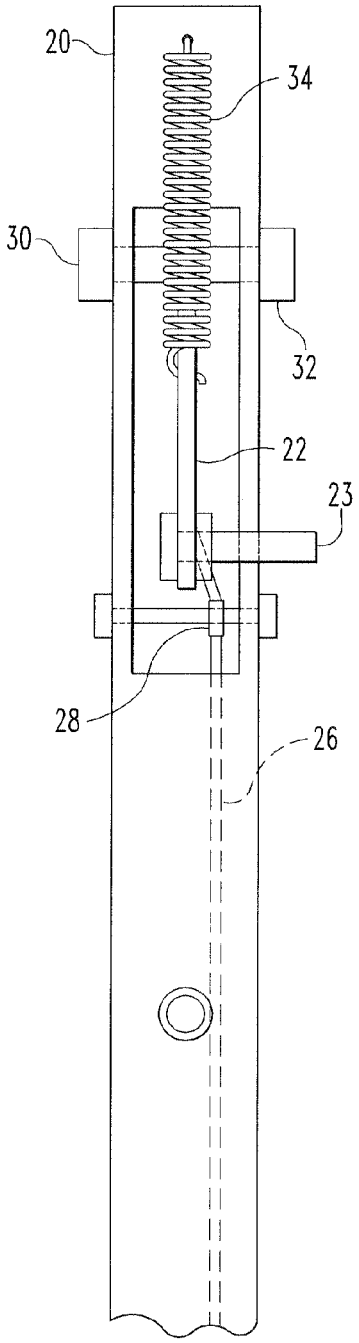
FIG. 3A is a partial rear view of the upper portion of the door handle extension of FIG. 1.
Figure 4:
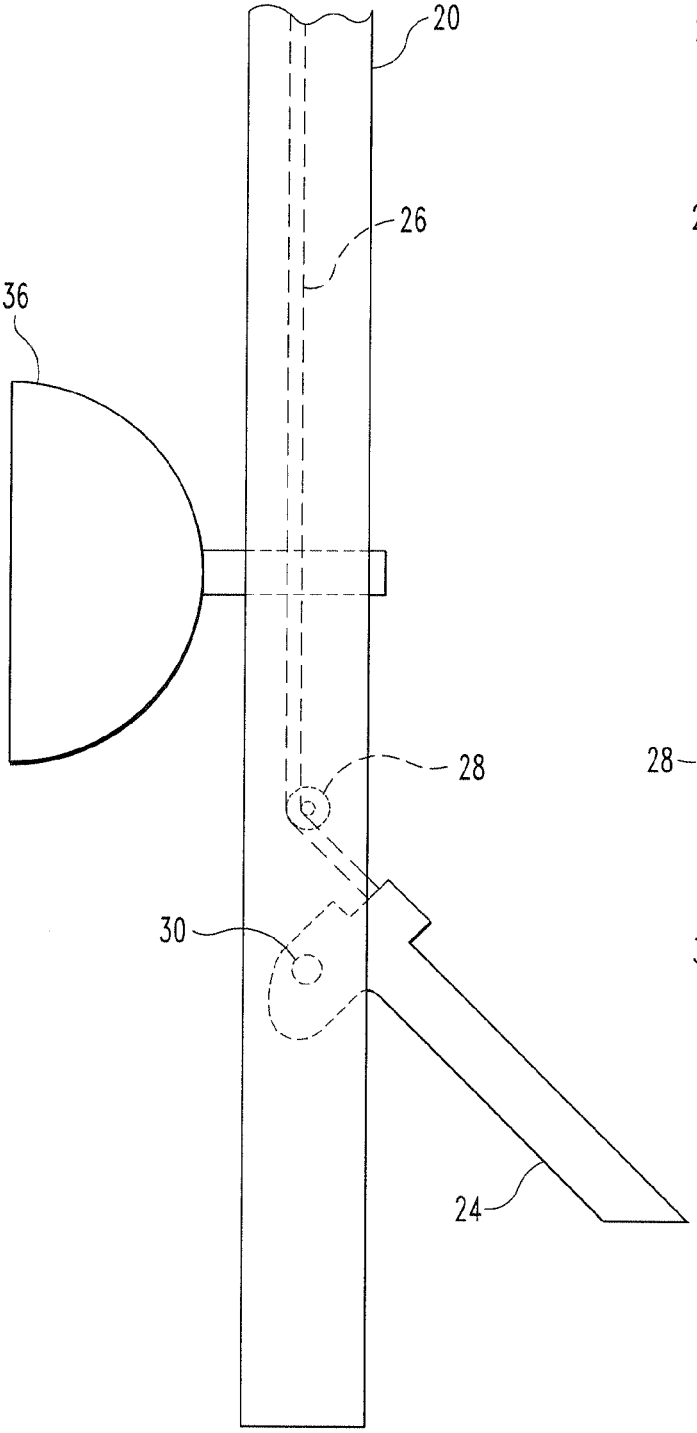
FIG. 4 is a left side view of the lower portion of the door handle extension of FIG. 1.
Figure 4A:
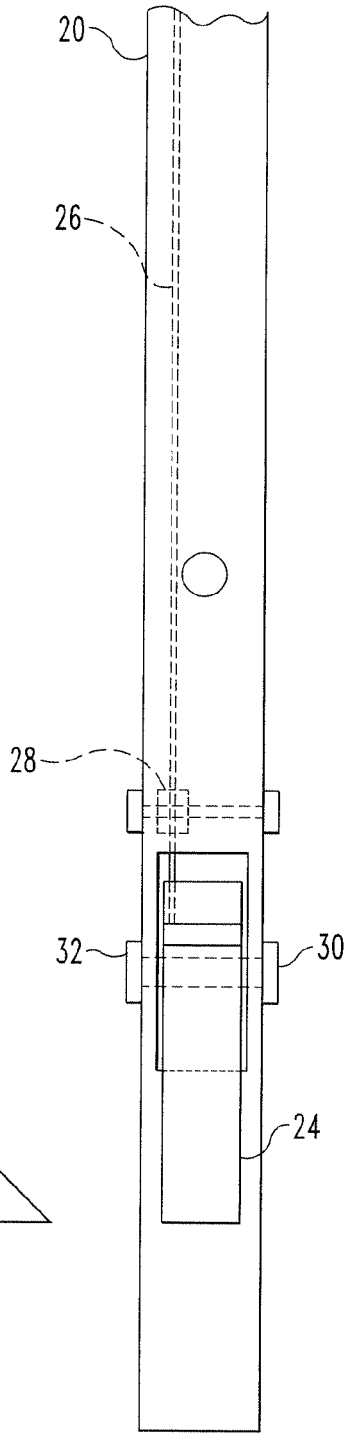
FIG. 4A is a partial front view of the lower portion of the door handle extension of FIG. 1.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIGS. 1-4 are drawings of a first embodiment of a door handle extension 10 according to the present invention. FIG. 1 shows the device mounted on a door 12 of the type having a nearly flush door handle 14 known as a paddle handle such as used on recreational vehicles, the door handle having a generally planar member, or paddle, 16 which is substantially flush with a face plate on the door surface and which pivots on a vertical axis, as illustrated in FIGS. 5-8 and perhaps best shown in FIGS. 8A and 8B. The door handle extension comprises a rigid bar 20 having a spring-biased lever arm 22 pivotally mounted on its upper end and an operating handle or lever 24 pivotally mounted on its lower end, as depicted in FIG. 1 and shown in more detail in FIG. 2 and further detail in FIGS. 3, 3A, 4 and 4A. A flexible but substantially inelastic cable or wire 26 interconnects the lever arm and the operating handle, preferably via an internal cable run within the bar, which in this embodiment is a hollow, square aluminum tube having an internal pulley 28 or other type of guide adjacent each end thereof for guiding the cable and keeping it generally parallel to the longitudinal axis of the bar between the pulleys.

Operating handle 24 and lever arm 22 are both vertically pivotally mounted, and the lever/cable system is configured to maintain tension on cable 26 and thus exert a pulling force on paddle 16 of vehicle door handle 14 when the operating handle is pressed down. More specifically, when the operating handle is actuated, it pulls the cable downwardly and the cable correspondingly pulls the free end of the spring-biased lever arm down and closer to bar 22. Lever arm 22 has a laterally extending pin 23 on its free end, visible in FIG. 1 and shown in detail in FIG. 3A, which is behind the paddle in use such that the outwardly moving pin engages the paddle and pulls it outwardly and thereby opens the door.

As detailed in the bill of materials below, levers 22 and 24 are pivotally mounted by means of bolts 30 and associated nuts 32 in the disclosed embodiment, and pulleys 28 are similarly secured inside bar 20 by nuts and bolts. Other means of attachment are contemplated, including rivets, other fasteners, and partial or complete cross-pins. An extension spring 34 provides the spring bias for lever 22.

Figure 5:
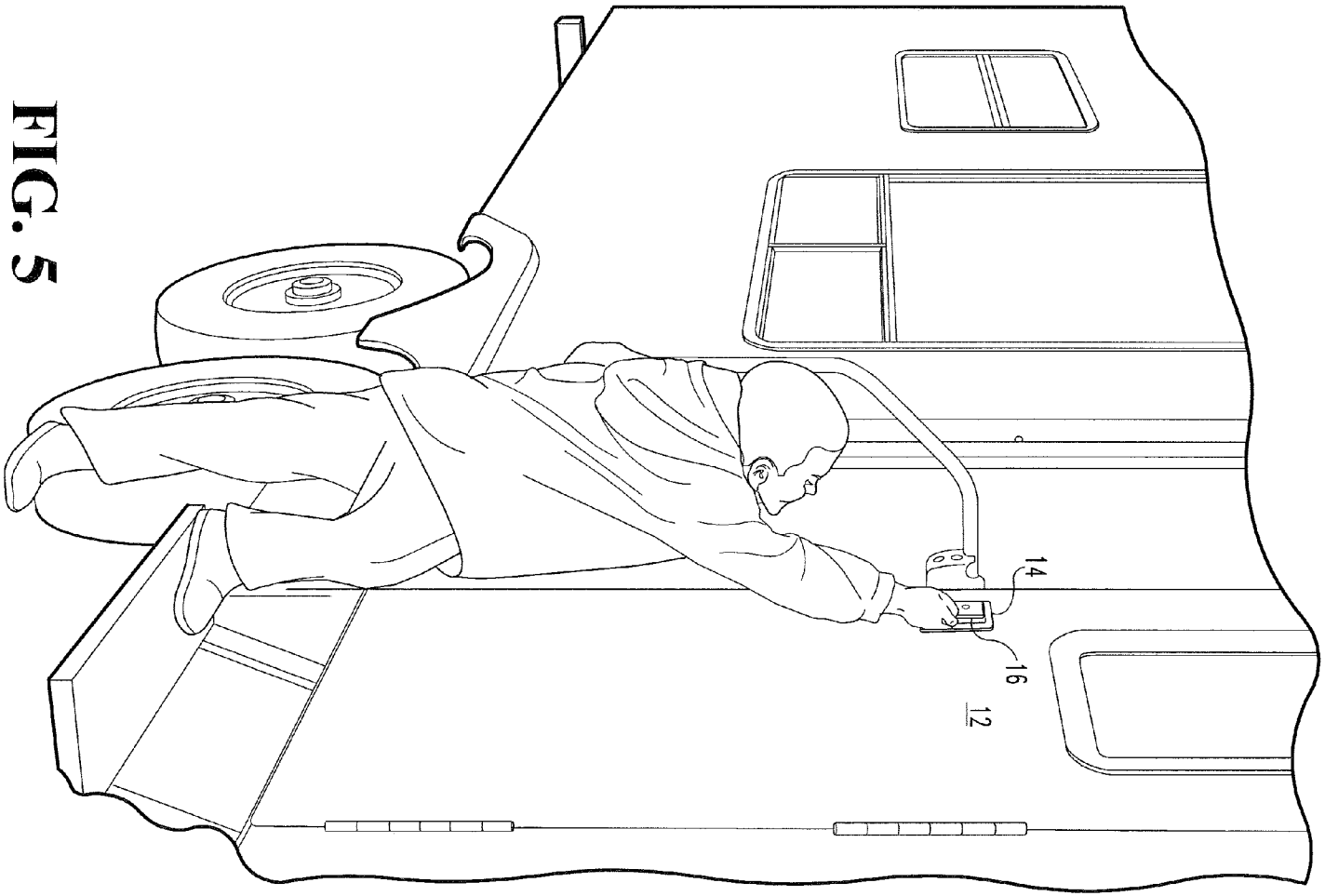
FIG. 5 shows a child climbing on the step of a conventional RV door to open the door.

The door handle extension allows its user to safely and easily enter any recreational vehicle with an elevated door such as a class A, fifth wheel, travel trailer, toy hauler, etc, without first mounting the steps to open the door because of the height of the door latch. FIG. 5 shows a child opening a conventional RV door and needing to climb the steps to do so. The child has to back away from the door, while still on the steps, to allow the door to fully open. This device effectively moves the opening mechanism of the door to the bottom of the door where it is more easily accessible to all. The device may be attached to the door using heavy duty suction cups 34 as shown in the drawings, thereby eliminating the need for permanent modifications to the door. This also allows the device to be readily removed when it is desired to move the vehicle, thereby maintaining the original profile of the vehicle for safety purposes during travel. The suction cups may be bolted to the aluminum tube as detailed in the bill of materials below. Alternatively, the door handle extension may be permanently attached to the door, or the door may be provided with a permanently attached mount adapted to allow the device to be quickly attached and detached, e.g., with a hook-and-slot arrangement such as used for attachment of bed rails to a headboard.

Figure 6:
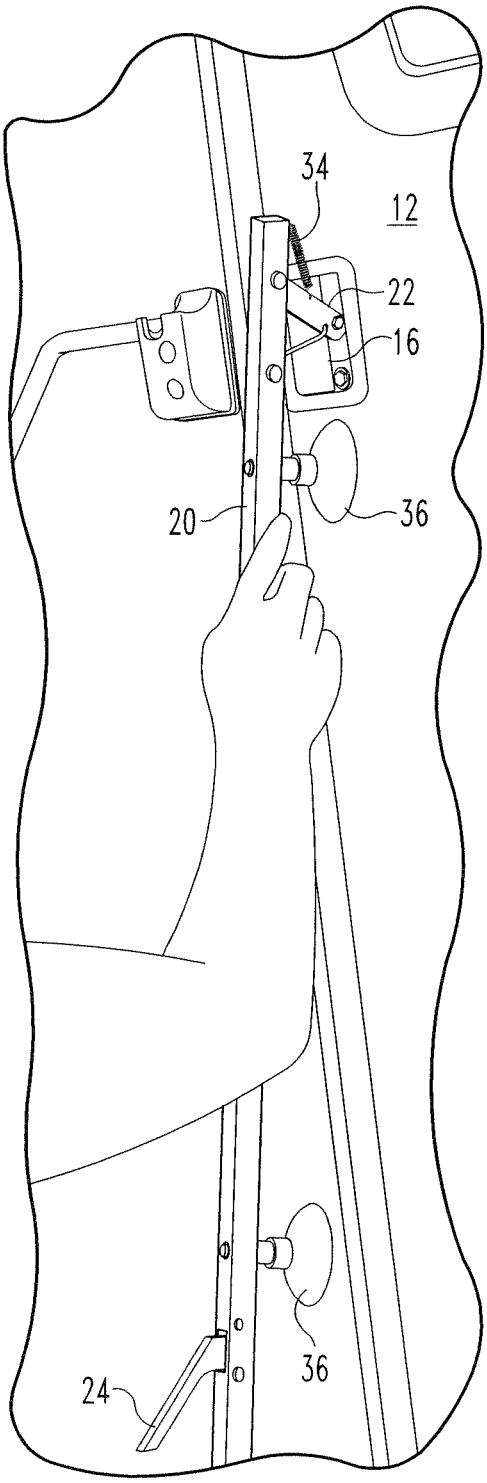
FIG. 6 shows the door handle extension of FIG. 1 in the process of being installed.
Figure 7A:
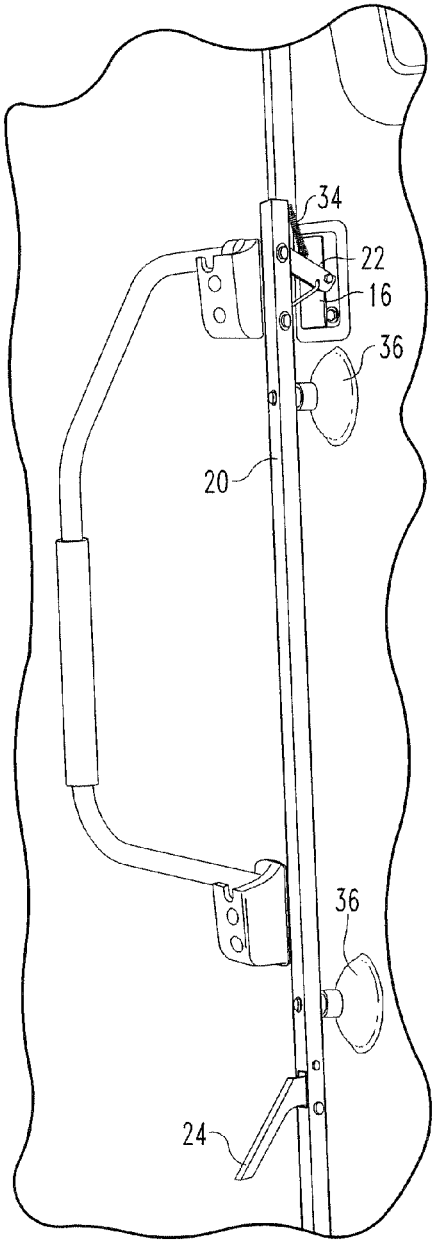
FIGS. 7A and 7B show the door handle extension of FIG. 1 installed and in its resting position (door closed) and in its door-opening position, respectively.
Figure 7B:
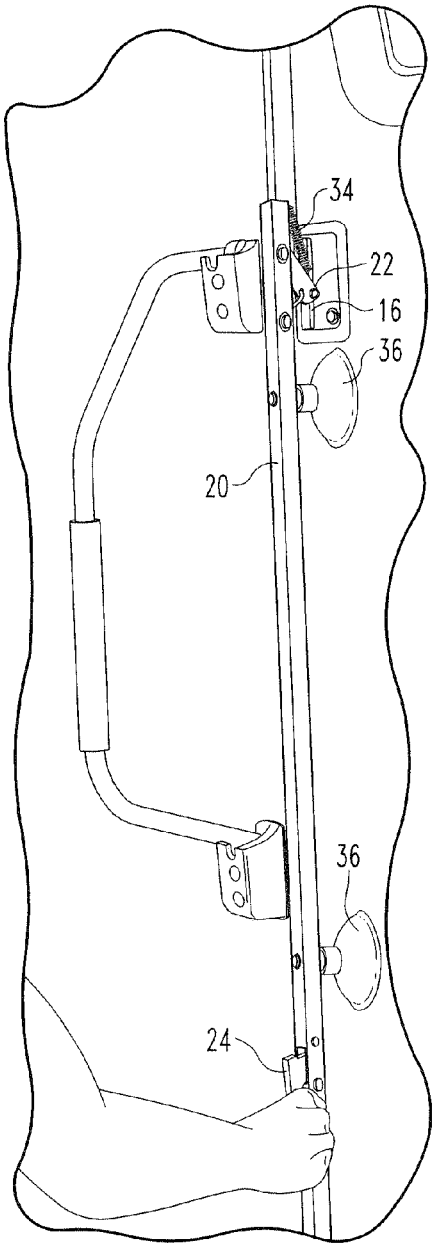
Figure 8A:
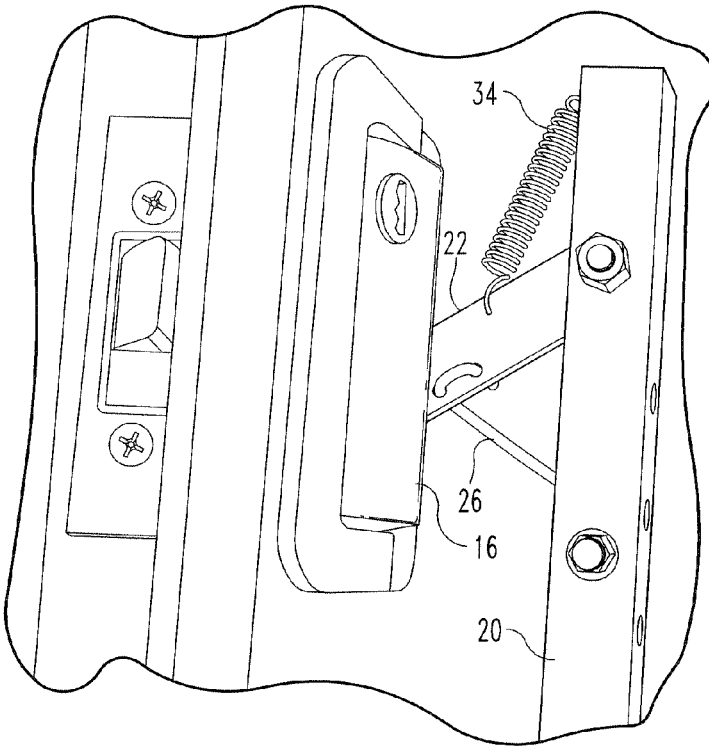
FIGS. 8A and 8B, respectively, show the resting position and door-opening position in more detail.
Figure 8B:
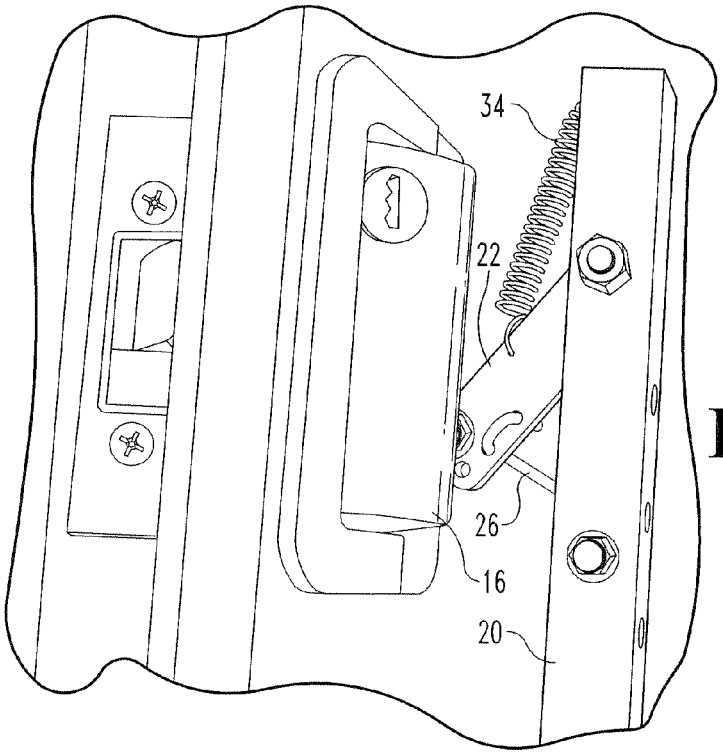

FIG. 6 shows the first step in the installation process, inserting the lever arm into the recess in the door handle assembly such that the pin on the end of the arm is behind, i.e., on the inboard side of, the paddle of the door handle. With the lever arm in position, the bar is held vertically against the door and the suction cups are pressed to hold the device on the door, preferably by first pressing the lower suction cup down. FIGS. 7A and 7B show one embodiment of the device in operation. FIG. 7A shows the resting position (door closed), and FIG. 7B shows the operating handle being pressed and the resulting downward and outward motion of the engaging end of the lever arm which produces a pulling force on the paddle and thereby causes the door to open. FIGS. 8A and 8B, respectively, show the resting position and door-opening position of the lever arm and paddle in more detail.

This device can be manufactured out of many different materials both natural and man-made. The following is one nonlimiting example of a bill of materials:

- 1 1/16" thick, 3/4"×36" aluminum square tube (alternative materials include wood, plastic, fiberglass, steel, stainless steel, etc.)
- 2 suction cups 3 1/8" wide×1 1/2" tall with 1/4"-20 steel nut hard molded inside
- 1 aluminum operating lever approximately 4" long×1/2" wide×1/4" thick, with 1 1/4" length from center of 1/4" bolt hole at pivot point to center of 1/8" hole where cable attaches (alternative lever materials include wood, plastic, fiberglass, steel, stainless steel, etc.)
- 1 cable (steel, coated steel, braided steel, wound steel, rope, twine, etc), 1/16" diameter×29 1/2" long, used to attach both levers utilizing the pulleys as guides
- 2 steel bolts 8-32×1 1/4" long, used to attach the pulleys to the inside of the aluminum tube
- 2 steel lock nuts 8-32 used with the 8-32 bolts in attachment process
- 2 steel washers 8-32 used with the 8-32 bolts in attachment process
- 2 1/4" steel bolts 1 1/4 long to go through the aluminum square tube attaching said tube to suction cups
- 2 1/4" washers used on the head end of the 1/4" bolts
- 2 1/4" fender washers used on the suction cup end between the suction cup and the spacer
- 1 3/4" wide×2 3/4" long×1/8" thick aluminum lever used to engage the door latch causing it to open when the other lever is squeezed
- 1 rod approximately 1" L×8/32" attached to the lever mechanism used to engage the door latch to cause it to open
- 2 1/4" steel bolts 1" long, used to attach each aluminum lever to the aluminum square tube in their respective positions along the tube, the bolts passing through one side of the tube and engaging the lever before passing through the other side, thus placing each lever directly in the middle of the square tube
- 2 1/4" lock nuts used with the 1/4"×1" bolts used to attach the levers
- 1 1 1/2" long×5/8" diameter×5/8 thick steel spring
- 2 3/8" steel spacers with 1/4" bolt holes While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected. For example, the device may have an adjustable length, e.g., with a telescoping two-piece shaft, one piece sliding inside the other and held in place with set screws or bolts that are tightened when the desired length is reached. The cable length in such an embodiment is correspondingly adjustable, e.g., by pulling the end of the cable through the operating handle as necessary to avoid slack, and tightening the cable with a set screw to maintain the desired length. It is also contemplated that the door handle extension may be built into the door as an internal device.

I claim:

1. A door handle extension for a paddle handle on a door of a recreational vehicle, comprising:

a hollow, rigid bar approximately three feet in length and one inch in width;

an internal cable extending longitudinally within said hollow bar at least three fourths the length thereof and constrained to longitudinal motion by a pulley near each end thereof;

a paddle-engaging, right-angle, elongate lever vertically pivotally mounted on the upper portion of said bar, said lever having a right-angled free end normally spaced apart from said bar and extending downwardly from the pivot point of said lever at an angle of approximately 45°, said right-angled free end extending approximately one inch from the longitudinal axis of said lever in a direction substantially parallel to the pivot axis of said lever such that said free end engages the inboard side of the paddle on the vehicle door when said door handle extension is installed with the door closed, said lever operatively connected to the upper end of said internal cable such that increased tension on said cable causes said lever to pivot downwardly toward said bar, said lever being spring-biased away from said downwardly pivoted position;

an operating handle vertically pivotally mounted on the lower portion of said bar and operatively connected to the lower end of said internal cable such that downward pivoting thereof causes increased tension on said cable; and first and second suction cups mounted on said upper and lower portions of said bar, closely adjacent to said lever and said handle, respectively, whereby said door handle extension can be readily attached to and removed from the vehicle door.

2. The door handle extension of claim 1, wherein said operating handle and said paddle-engaging lever are pivotally mounted inside said hollow bar and extend out from opposite front and rear walls thereof, respectively.

3. The door handle extension of claim 2, wherein said pulley near each end of said cable includes an upper pulley and lower pulley inside said hollow bar, wherein said cable is attached to said paddle-engaging lever near said free end thereof and runs on the front of said upper pulley and the rear of said lower pulley to an attachment point on said operating handle adjacent to and forward of the pivot point thereof.

4. The door handle extension of claim 3, wherein said paddle-engaging lever is spring-biased by an extension spring attached on one end to said lever between its free end and pivot end and attached on the other end to the top of said rear wall of said bar.

* * * * *